US005173993A

United States Patent [19]

Baker

[11] Patent Number: 5,173,993

[45] Date of Patent: Dec. 29, 1992

[54] ADJUSTABLE LOCKING DOOR HINGE

[75] Inventor: Eldon R. Baker, Redding, Calif.

[73] Assignee: Unlimited Ideas and Designs Inc., Redding, Calif.

[21] Appl. No.: 784,883

[22] Filed: Oct. 30, 1991

[51] Int. Cl.[5] ..... E05D 11/10; E05C 17/64

[52] U.S. Cl. ..... 16/329; 16/340

[58] Field of Search ..... 16/322, 329, 340, 353

[56] References Cited

U.S. PATENT DOCUMENTS 3,874,029 4/1975 McCullough ..... 16/329

4,829,633 5/1989 Kassner ..... 16/322

FOREIGN PATENT DOCUMENTS 502276 3/1939 United Kingdom ..... 16/340

*Primary Examiner*—John Sipos

*Assistant Examiner*—Carmine Cuda

*Attorney, Agent, or Firm*—Richard C. Litman

[57] ABSTRACT

A locking hinge assembly includes two butt plates or hinge leaves each having a plurality of interlocking knuckles with an axially shiftable hinge pin mating with the knuckles. A locking mechanism carried by the top of the hinge pin includes pressure and sprocket plates, with one plate keyed to the hinge pin and spring devices adjustably compressible to apply varying degrees of biasing force against the movement of one hinge leaf relative the other hinge leaf. This is accomplished due to the juncture of one hinge leaf to the sprocket plate while the keyed pressure plate is fixed relative the other hinge plate.

9 Claims, 3 Drawing Sheets

ADJUSTABLE LOCKING DOOR HINGE

FIELD OF THE INVENTION

The present invention relates to improvements in a locking door hinge. More particularly the invention relates to a door hinge assembly which allows not only for the retention of a door at any desired open position but also permits adjustment of the amount of frictional resistance exhibited during opening and closing of the door.

DESCRIPTION OF THE PRIOR ART

Lockable hinge assemblies are generally well known in the art. U.S. Pat. No. 2,427,384 issued to Bushko discloses an adjustable door hinge wherein a cam mechanism actuates a locking mechanism to arrest the free motion of a door. U.S. Pat. No. 3,629,900 issued to Beerli, Jr. illustrates a locking hinge utilizing an axially shiftable hinge pin having a toothed portion engageable with a mating portion on one of the hinge leaves to secure a door in a desired open position.

U.S. Pat. No. 3,744,085 issued to Griego discloses a further example of a hinge which can be locked in a selected angular position by means of an axially shiftable hinge pin. The locking is achieved by a hexagonal plug carried by the hinge pin and which cooperates with a mating socket within a hinge leaf knuckle.

None of the above inventions and patents, taken either singly or in combination, is seen to suggest the instant invention as claimed herein.

SUMMARY OF THE INVENTION

It is often required to keep a door open for a variety of purposes; however, in some cases a physical door stop would be inconvenient. It may, for instance, obstruct free movement through the door or even cause injury. Also it is often required to keep a door partially open, or to change the amount of door opening as the situation changes. It would not be convenient to reset the door stop each time the requirement to change the amount of door opening changes. Additionally, it is advantageous to have ready means available to permit alternation of the frictional resistance as presented by a hung door and its hinges. In this manner, a user would be able to accommodate ambient drafts or an out of plumb installation wherein the door would have a tendency to self close or open.

The present invention provides an easy to use locking hinge assembly which is readily adjustable without any tools to permit variation of the biasing force as exhibited by a hung door and which allows retention of the door in any desired pivotal position. This adjustment is accomplished by manipulation of an axially displaceable hinge pin between alternate positions. In a released position, the hinge leaves and attached door are freely connected. In the locked position, a sprocket mounted upon the hinge pin interlocks with catch means fixed relative one of the hinge leaves. The degree of biasing action between the two hinge leaves is regulated by the adjustment of a nut which controls the clamping force as applied by a slip clutch comprising yieldable washers disposed between the nut and a base element affixed to one of the hinge leaves. The hinge pin is precluded from independent rotary motion by means of a transverse pin carried thereby and disposed within an axial slot in the knuckle of one of the hinge leaves. Positive limits of travel of the shiftable hinge pin are defined by snap-action detent means on the hinge pin and one of the knuckles on the same hinge leaf as engaged by the above transverse pin. Engagement or disengagement of the biasing/locking device is achieved merely by pushing downwardly or upwardly upon a respective end of the hinge pin while alteration of the resistive force is easily made by tightening or loosening the nut member at the top of the hinge pin, usually when the pin is in its lowered, locked position. The exposed, working elements of the locking mechanism at the top of the pin are usually enshrouded by a protective cap or shield, with only the uppermost adjustable nut projecting therethrough. In this manner, the locking-unlocking action may be carried out at any time without exposing the various elements as contained within the cap.

Accordingly, one of the objects of the present invention is to provide a locking hinge assembly which can be easily actuated to achieve varying degrees of frictional resistance between the pivotal motion of the hinge leaves.

Another object of the present invention is to provide an improved lockable hinge assembly including an axially shiftable hinge pin nonrotatably fixed relative one hinge leaf and supporting a variably adjustable clutch mechanism at an end of the pin, together with sprocket and catch elements allowing of selective actuation of a biasing force between the two hinge leaves.

A further object of the present invention is to provide an improved lockable hinge assembly including a catch element fixed relative one hinge leaf and which is engageable with a sprocket freely carried by the hinge pin, while a clutch mechanism is variably engageable with the sprocket to regulate the frictional resistance between the two hinge leaves.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several drawing figures.

DETAILED DESCRIPTION OF THE PREFERRED EMBODIMENT

Figure 1:
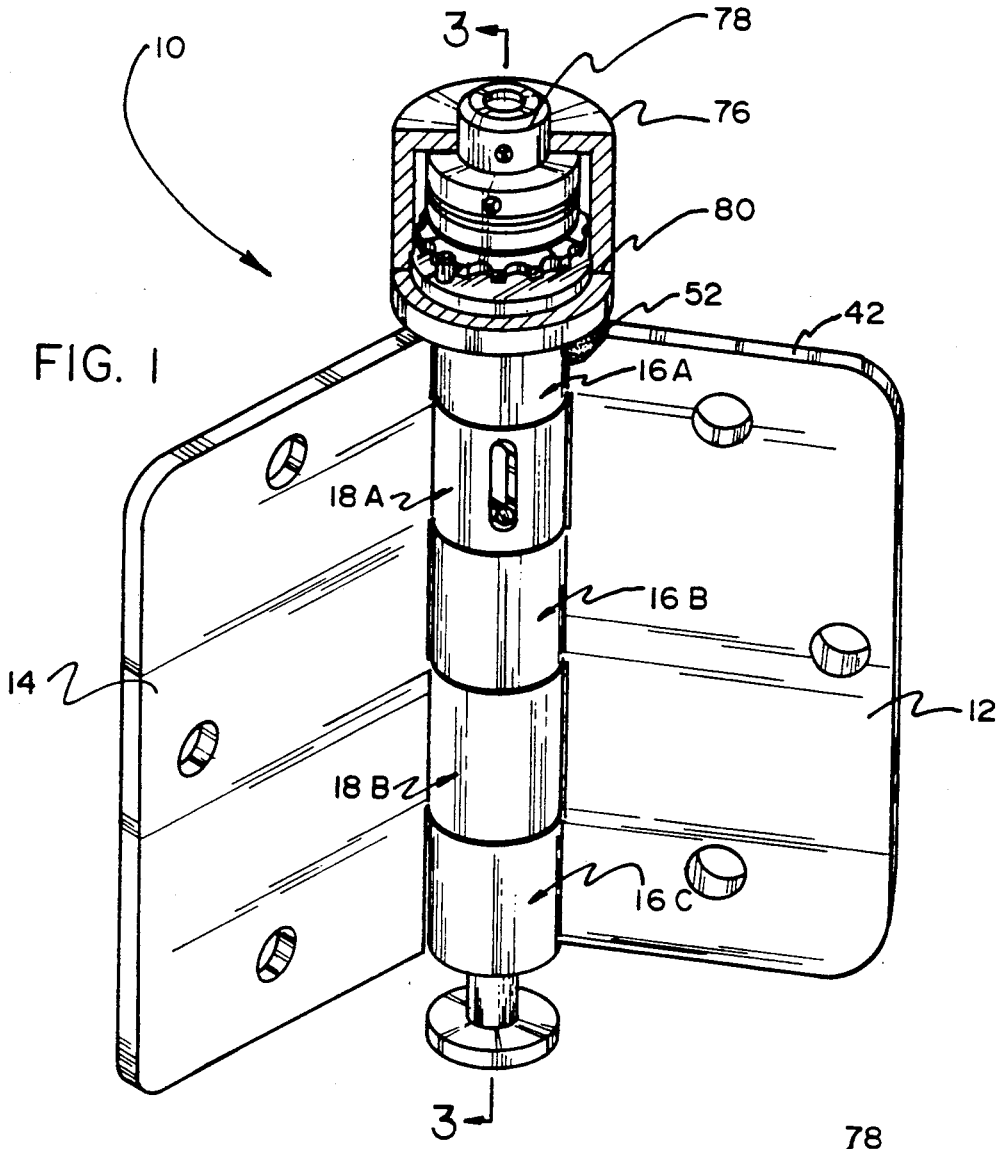
FIG. 1 is a front perspective view partially cut-away to illustrate the mechanism at the top of the hinge pin.

Referring now to the drawings, particularly FIG. 1, the locking hinge assembly 10 will be seen to be applied to a pair of conventional hinge butt plates or hinge leaves 12,14, each having a plurality of intermeshed knuckles **16*a*,16*b*,16*c* and, 18*a*,18*b* respectively. The leaves are maintained in the assembled condition by means of a hinge pin 20 comprising a unitary elongated element, the opposite ends of which define a length substantially greater than the height of the leaves 12,14**.

Figure 2:
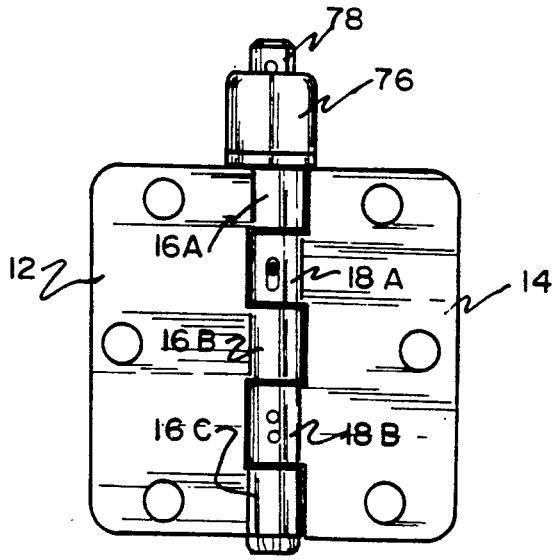
FIG. 2 is a rear elevational view of the apparatus of FIG. 1.

As shown most clearly in FIG. 2, the lower end 22 of the pin is provided with an enlarged end cap 24 and which may be affixed by any suitable means, such as the illustrated screw 26. Movement of the hinge pin 20 is restricted by means of a transverse dowel or roll pin 28 carried by the hinge pin and having its opposite ends captively located within diametrically opposed axially extending slots 30,30 formed in one of the knuckles 18*a* of one hinge leaf 14.

Figure 3:
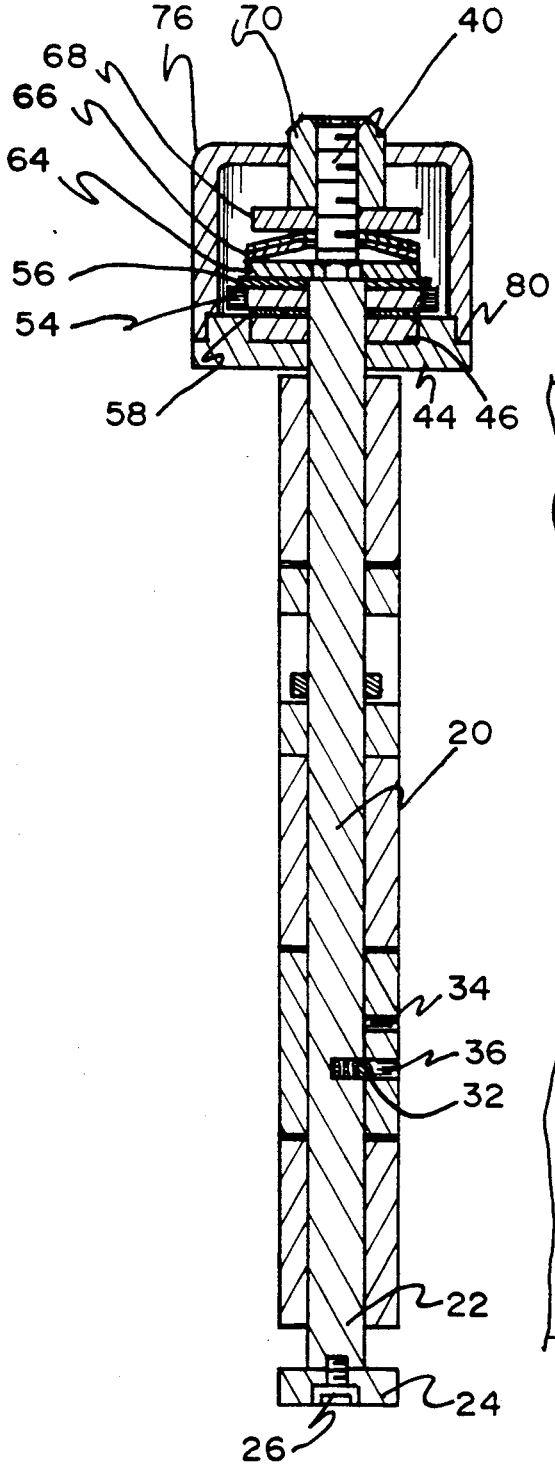
FIG. 3 is a vertical sectional view along line 3—3 of FIG. 1, with the hinge assembly in the locked (engaged) position.
Figure 4:
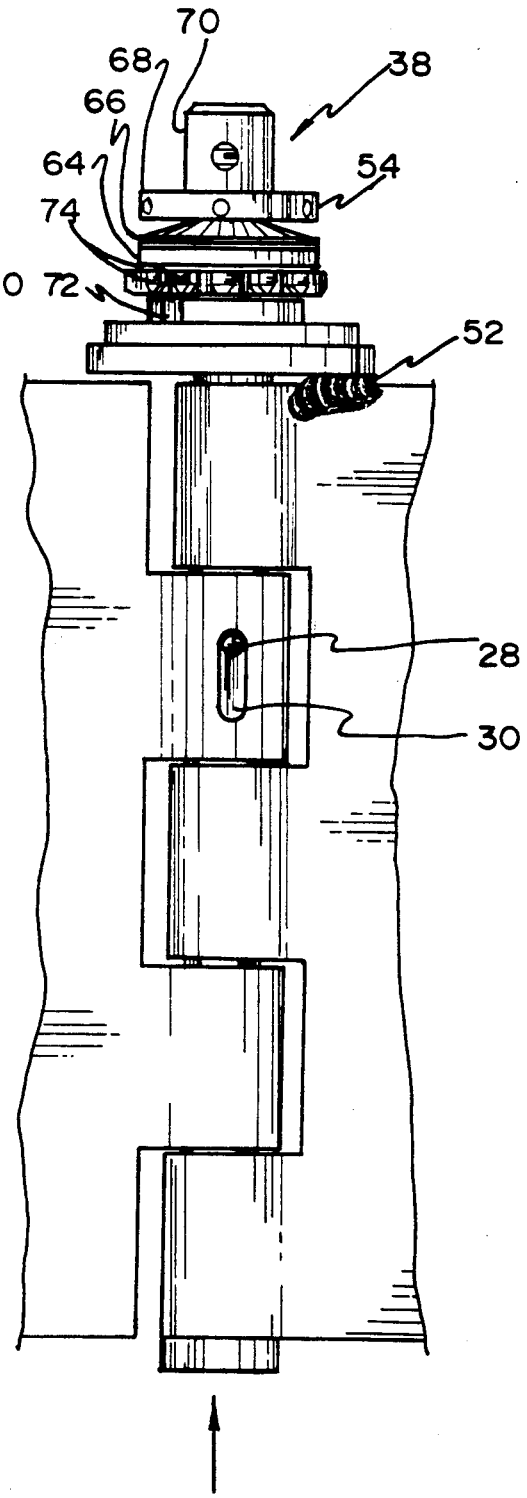
FIG. 4 is a partial front elevation of the hinge assembly in the disengaged position.
Figure 5:
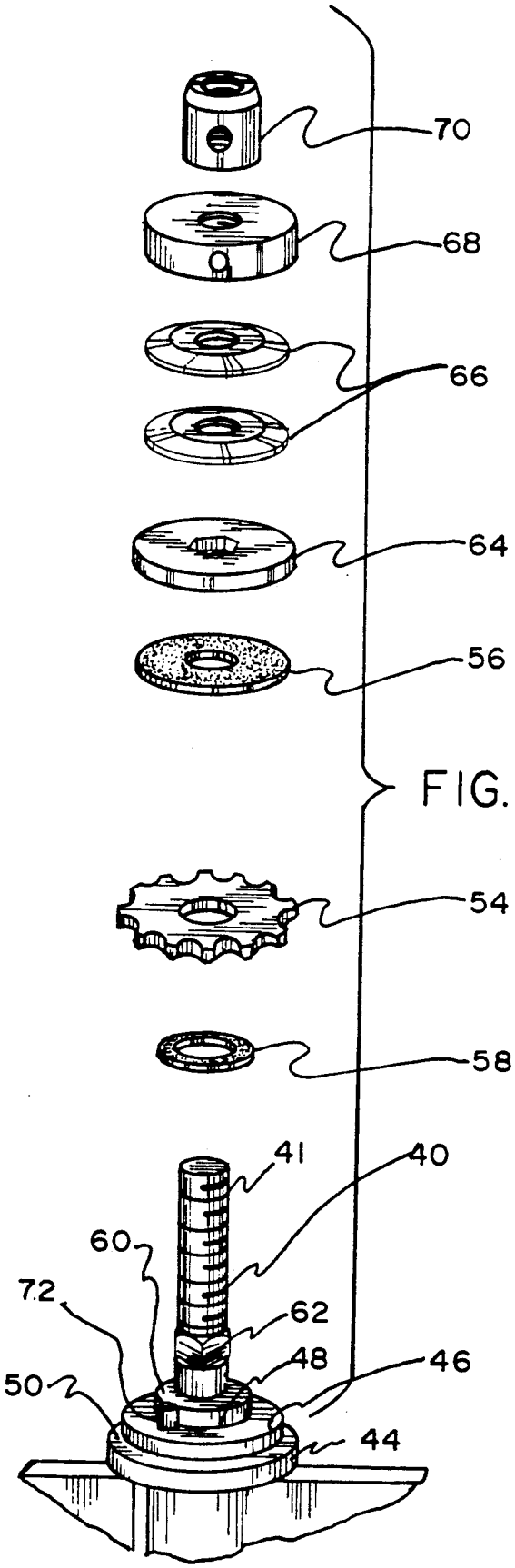
FIG. 5 is an exploded perspective view of the principal components of the locking mechanism.

The above construction will be understood to permit the free axial displacement of the hinge pin 20 between the limits of the locked position as shown in FIGS. 1 and 3 and the unlocked position of FIGS. 2 and 4. To provide means to positively retain the hinge pin in either of these two positions, snap means in the form of a spring-urged ball 32 is carried by the hinge pin 20, with the ball alternately cooperating with upper and lower bores forming detents 34,36 in the knuckle 18*b* which is part of the same hinge leaf 14 as that containing the knuckle 18*a* engaged by the dowel 28. With this arrangement, as the hinge pin is axially shifted, it will at all times remain nonrotatably fixed relative the hinge leaf 14, regardless of its pivotal relationship to the other hinge leaf 12.

Locking, or regulation of the biasing action between the two hinge leaves, is controlled by manipulation of the locking mechanism 38 surrounding the upper portion 40 of the hinge pin 20, as located above the top edge 42 of the hinge leaves. This mechanism includes a circular base element 44 having an upper wall 46 and a central bore 48 through which the pin upper portion passes. The periphery of the base element 44 will be seen to be stepped so as to provide a shelf 50 for reasons which will become apparent hereinafter. This base element is secured against independent axial or arcuate displacement by being attached to the hinge leaf 12, as by the weld 52. With the foregoing in mind, it will be noted that the base element 44 is fixed relative the first hinge leaf 12 while the hinge pin 20 is keyed to the second hinge leaf 14. This relationship will be of importance in supporting the operation of the device.

The various other plurality of components of the locking mechanism all comprise circular elements mounted atop the base element 44 and surrounding the upstanding pin upper portion 40. A sprocket plate 54, bounded by top and bottom flat washers 56,58 revolves about the pin and is supported atop the shoulder 60 presented by the enlarged portion of the hinge pin. Immediately above the sprocket plate 54, the hinge pin is formed with a polygonal cross-section 62, to which is affixed a pressure plate 64. The remainder of the pin upper portion is threaded, as at 41 and freely accommodates a plurality of compressible washer members such as the illustrated Belleville washers 66. An actuating disc 68 having a threaded bore reposes above the washers 66 while the endmost element comprises a nut member 70.

When the locking assembly 38 is in the elevated position of FIG. 4, the two hinge leaves 12,14 are free to pivot about the common hinge pin 20, without any biasing resistance being offered by the locking assembly. On the other hand, upon pushing down on the hinge pin 20, the entire locking assembly 30 is lowered. Since the sprocket plate 54 is substantially flush with the pin shoulder 60, it follows that the sprocket plate will be displaced to a position substantially juxtaposed the top wall 46 of the base element 44. During this latter movement, an interlocking occurs between the sprocket plate 54 and the first hinge leaf 12. This is provided by a catch or stud 72 projecting upwardly from the base element top wall 46 and which engages between a pair of adjacent teeth 74, 74 on the sprocket plate. As shown in FIG. 4, the bottom of these teeth are beveled to facilitate the admission of the catch 72 between two adjacent teeth as the pin 20 is pushed downwardly.

When shifted to the lowered or locked position, the base element 44, sprocket plate 54 and first hinge leaf 16 become as one, while the hinge pin 20, pressure plate 64 and second hinge leaf 14 are all interlocked as another body. It thus follows that any frictional resistance brought to bear between these two sets of components will in turn, produce a resistance between the normal pivoting of the two hinge leaves. Such frictional resistance is regulated by the application of a compressive force upon the washers 66 and which is transmitted as a downward force urging the pressure plate 64 against the sprocket plate 54, the latter of which is bearing upon the shoulder 60 of the hinge pin 20. Since the pressure plate 64 is keyed relative the hinge pin 20, it will be appreciated that any drag imposed upon the pressure plate will be transmitted to the second hinge plate 14 by way of the dowel 28 whereby, a corresponding frictional resistance between the pivoting of the two hinge leaves 12, 14 is created.

Variation of the biasing force is readily accomplished by advancing or retracting the actuating disc and jam nut 70 along the pin threads 41 so as to alter the compressive force being applied to the spring washers 66. Obviously, alternate numbers and sizes of Belleville springs or washers may be employed according to specific requirements and hinge sizes.

When it is desired to release the locking mechanism 38, one merely pushes up upon the lower end cap 24, to position the components as in FIG. 4 whereupon the sprocket plate 54 is elevated from its engagement with the catch 72 and the two leaves 12, 14 assume a natural pivoting about the common hinge pin 20.

To protect the locking components and present a more pleasing appearance, a top cap 76 having a central opening 78 snapfits into the position shown in FIGS. 1 and 3. This fitting occurs due to a press fit between the cap skirt 80 and the base element shelf 50.

From the foregoing it will be appreciated that an improved locking hinge assembly is provided allowing of ready variation of a biasing force between two hinge leaves and wherein this force may be selected to merely retard the free movement of a hung door or to more positively retain a door in a desired position.

It is to be understood that the present invention is not limited to the sole embodiment described above, but encompasses any and all embodiments within the scope of the following claims.

I claim:

1. A locking hinge assembly comprising;

first and second hinge leaves respectfully having first and second cylindrical knuckles in intermeshing relationship, a hinge pin extending through said first and second knuckles, said hinge pin having upper and lower portions axially extendible beyond said first and second knuckles and axially shiftable with respect to said knuckles, means nonrotatably fixing said hinge pin relative said second hinge leaf, a locking mechanism surrounding said hinge pin upper portion and including a base element fixed relative said first hinge leaf, catch means projecting from said base element, a sprocket plate disposed above said base element and axially shiftable with said hinge pin to locked and unlocked positions respectively engageable with and released from, said catch means, a pressure plate keyed to said hinge pin upper portion above said sprocket plate, spring means adjacent said pressure plate, and actuating means adjustably shiftable on said hinge pin upper portion to variably compress said spring means to apply a biasing force resisting arcuate displacement between said sprocket and pressure plates.

2. A locking hinge assembly as claimed in claim 1 including, an axially extending slot within one said knuckle of said second hinge leaf, and said nonrotatably fixing means includes a transverse member carried by said hinge pin and projecting into said slot.

3. A locking hinge assembly as claimed in claim 1 wherein, said sprocket plate includes peripheral teeth and said catch means comprises an upstanding pin.

4. A locking hinge assembly as claimed in claim 1 wherein, said spring means includes a compressible washer.

5. A locking hinge assembly as claimed in claim 1 wherein, said spring means includes a Belleville washer.

6. A locking hinge assembly as claimed in claim 1 including, positive limit means defining locked and unlocked positions of said hinge pin, said limit means including a spring-urged ball carried by said hinge pin and cooperating with a pair of detents in one said knuckle.

7. A locking hinge assembly as claimed in claim 1 wherein, said hinge pin upper portion is threaded, and said actuating means including an actuating disc threadedly attached to said hinge pin upper portion.

8. A locking hinge assembly as claimed in claim 1 including, a protective cap removably attachable to said base element.

9. A locking hinge assembly as claimed in claim 7 including, a jam nut on said threaded upper portion adjacent said actuating disc.

* * * * *